US010087685B1

(12) United States Patent
Cooley et al.

(10) Patent No.: US 10,087,685 B1
(45) Date of Patent: Oct. 2, 2018

(54) SHEAR-RESISTANT JOINT BETWEEN A SUPERABRASIVE BODY AND A SUBSTRATE

(71) Applicant: US Synthetic Corporation, Orem, UT (US)

(72) Inventors: Craig H. Cooley, Saratoga Springs, UT (US); Carl G. Wood, Orem, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 198 days.

(21) Appl. No.: 15/189,888

(22) Filed: Jun. 22, 2016

Related U.S. Application Data

(60) Provisional application No. 62/188,307, filed on Jul. 2, 2015.

(51) Int. Cl.

| | |
|---|---|
| ***B24D 3/06*** | (2006.01) |
| ***E21B 10/573*** | (2006.01) |
| ***E21B 10/55*** | (2006.01) |
| ***B24D 18/00*** | (2006.01) |

(52) U.S. Cl.
CPC ..... *E21B 10/5735* (2013.01); *B24D 18/0009* (2013.01); *E21B 10/55* (2013.01)

(58) Field of Classification Search
CPC ..... E21B 10/573; E21B 10/5735; E21B 2010/563; E21B 2010/564; E21B 2010/565; B24D 3/06
USPC ..... 51/309; 175/432
See application file for complete search history.

(56) References Cited

U.S. PATENT DOCUMENTS

| | | | | |
|---|---|---|---|---|
| 4,268,276 | A | 5/1981 | Bovenkerk | |
| 4,410,054 | A | 10/1983 | Nagel et al. | |
| 4,468,138 | A | 8/1984 | Nagel | |
| 4,560,014 | A | 12/1985 | Geczy | |
| 4,738,322 | A | 4/1988 | Hall et al. | |
| 4,811,801 | A | 3/1989 | Salesky et al. | |
| 4,913,247 | A | 4/1990 | Jones | |
| 5,016,718 | A | 5/1991 | Tandberg | |
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 6,149,695 | A * | 11/2000 | Adia | B23B 51/00 407/119 |
| 6,401,845 | B1 * | 6/2002 | Fielder | E21B 10/5735 175/428 |
| 6,793,681 | B1 | 9/2004 | Pope et al. | |
| 7,866,418 | B2 | 1/2011 | Bertagnolli et al. | |

(Continued)

OTHER PUBLICATIONS

U.S. Appl. No. 62/188,307, filed Jul. 2, 2015.

(Continued)

*Primary Examiner* — Kenneth L Thompson
(74) *Attorney, Agent, or Firm* — Dorsey & Whitney LLP

(57) ABSTRACT

Embodiments disclosed herein relate to superabrasive compacts having a metallic member disposed between a superabrasive body and a substrate; and drill bits and methods of making the same.

20 Claims, 11 Drawing Sheets

(56) References Cited

U.S. PATENT DOCUMENTS

| | | | | |
|---|---|---|---|---|
| 8,783,389 | B2 * | 7/2014 | Fan | B24D 99/005 175/433 |
| 8,899,358 | B2 * | 12/2014 | Yu | B22F 3/12 175/420.2 |
| 9,199,356 | B2 * | 12/2015 | Liversage | B24D 18/00 |
| 2010/0012389 | A1 * | 1/2010 | Zhang | B24D 99/005 175/432 |
| 2014/0202774 | A1 * | 7/2014 | Bowden | B32B 7/12 175/432 |
| 2018/0036696 | A1 * | 2/2018 | Can | B01J 3/062 |

OTHER PUBLICATIONS

U.S. Appl. No. 12/555,715, filed Sep. 8, 2009.
U.S. Appl. No. 13/324,237, filed Dec. 13, 2011.
U.S. Appl. No. 13/751,405, filed Jan. 28, 2013.

* cited by examiner

SHEAR-RESISTANT JOINT BETWEEN A SUPERABRASIVE BODY AND A SUBSTRATE

CROSS-REFERENCE TO RELATED APPLICATIONS

This application claims priority to U.S. Provisional Application No. 62/188,307 filed on 2 Jul. 2015, the disclosure of which is incorporated herein, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer commonly referred to as a diamond table. The diamond table is formed and bonded to a substrate using a high-pressure/high-temperature ("HPHT") process.

A fixed-cutter rotary drill bit typically includes a number of PDC cutting elements affixed to a bit body. PDC cutting elements are typically brazed directly into a preformed recess formed in the bit body of the fixed-cutter rotary drill bit. In some applications, the substrate of the PDC cutting element may be brazed or otherwise joined to an attachment member, such as a cylindrical backing, which may be secured to the bit body by press-fitting or brazing.

SUMMARY

Embodiments disclosed herein relate to superabrasive compacts having a metallic member disposed between and bonding a superabrasive table to a substrate; and drill bits and methods of making the same. In an embodiment, a superabrasive compact is disclosed. The superabrasive compact includes a superabrasive body including a plurality of bonded superabrasive grains, an upper surface, a bonding surface having a surface feature, and a lateral surface extending between the upper surface and the bonding surface. The superabrasive compact includes a substrate including a base surface, an interfacial surface having a substrate surface feature, and a substrate lateral surface extending therebetween. The superabrasive compact includes a metallic member disposed between the bonding surface and the interfacial surface. The metallic member deformed to substantially conform to the surface feature of the bonding surface and the substrate surface feature of the interfacial surface.

In an embodiment, a cutter bit assembly is disclosed. The cutter bit assembly includes a cutter pocket including a back wall and a seat substantially perpendicular thereto. The cutter pocket sized and configured to hold a cutting element therein. The cutting element includes a superabrasive body including a plurality of bonded superabrasive grains, an upper surface, a bonding surface having a surface feature, and a lateral surface extending between the upper surface and the bonding surface. The cutter element further includes a substrate including a base surface, an interfacial surface having a substrate surface feature, and a substrate lateral surface extending therebetween. The cutting element further includes a metallic member disposed between the bonding surface and the interfacial surface. The metallic member being deformed to substantially conform to the surface feature of the bonding surface and the substrate surface feature of the interfacial surface. The cutter bit assembly further includes at least one retaining member configured to apply a clamping force against the superabrasive body to bias the base surface of the substrate against the back wall of the cutter pocket.

In an embodiment a drill bit is disclosed. The drill bit includes a bit body including a leading end structure configured to facilitate drilling a subterranean formation and a plurality of cutting elements mounted to the bit body. At least one of the plurality of cutting elements including a superabrasive body including a plurality of bonded superabrasive grains, an upper surface, a bonding surface having a surface feature, and a lateral surface extending between the upper surface and the bonding surface; a substrate including a base surface, an interfacial surface having a substrate surface feature, and a substrate lateral surface extending therebetween; a metallic member disposed between the bonding surface and the interfacial surface, the metallic member being deformed to substantially conform to the surface feature of the bonding surface and the substrate surface feature of the interfacial surface.

In an embodiment, a method of making a superabrasive compact is disclosed. The method comprising providing an assembly. The assembly includes a superabrasive body including a plurality of bonded superabrasive grains, an upper surface, a bonding surface having a surface feature, and a lateral surface extending between the upper surface and the bonding surface; a substrate including a base surface, an interfacial surface having a substrate surface feature, and a substrate lateral surface extending therebetween; and a metallic member disposed between the bonding surface and the interfacial surface. The method further includes forcing the superabrasive body and substrate toward one another at a temperature below a melting point of the metallic member effective to cause the metallic member to deform into the surface feature of the bonding surface and the substrate surface feature of the interfacial surface.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments disclosed herein relate to superabrasive compacts having a metallic member disposed between and bonding a superabrasive table to a substrate; and drill bits and methods of making the same. The superabrasive compacts disclosed herein include a superabrasive body (e.g., PCD table) bonded to a substrate (e.g., a cemented tungsten carbide substrate) via a metallic member disposed therebetween. The superabrasive body and the substrate may each include at least partially complementary (e.g., three dimensionally textured) surfaces configured to mate with the metallic member, on opposite sides thereof. The metallic member may include a ductile metal that may be heated (to a temperature below its respective melting point) and pressed into the interface surfaces of superabrasive body and the substrate to form a shear-resistant joint therebetween. The shear-resistant joint may provide a mechanical bond between the interface surfaces and the metallic member even when substantially no wetting of the superabrasive material (or the substrate) by the metallic member occurs.

Figure 1A:
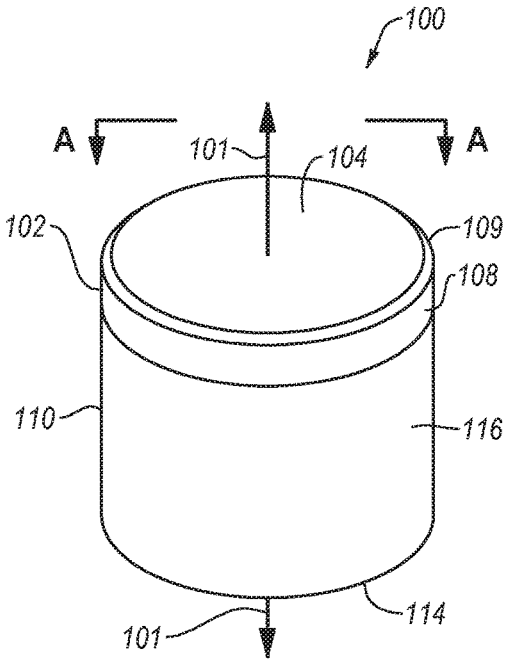
FIG. 1A is an isometric view of a superabrasive compact, according to an embodiment.
Figure 1B:
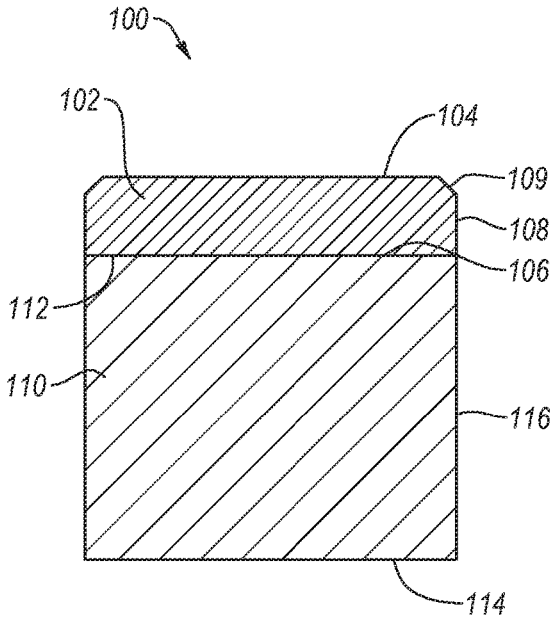
FIG. 1B is a cross-sectional view of the superabrasive compact of FIG. 1A taken along the plane A-A.

FIG. 1A is an isometric view of a superabrasive compact 100, which may be used in the formation of superabrasive compacts disclosed herein such as the superabrasive compacts shown in FIGS. 2A-4A. FIG. 1B is a cross-sectional view of the superabrasive compact 100 of FIG. 1A taken along the plane A-A. The superabrasive compact 100 includes a superabrasive body 102 (e.g., PCD table) including a plurality of bonded superabrasive grains. The superabrasive body 102 includes an upper surface 104, a bonding surface 106 generally opposite the upper surface 104, and a lateral surface 108 extending between the upper surface 104 and the bonding surface 106. Optionally, the superabrasive body 102 may include a chamfer 109 extending between the upper surface 104 and the lateral surface 108. The bonding surface 106 may be configured to interface with a substrate 110, such as having a complementary surface geometry (e.g., planarity to match an interfacial surface of the substrate 110).

The substrate 110 includes an interfacial surface 112, a base surface 114, and a substrate lateral surface 116 extending between the interfacial surface 112 and the base surface 114. The interfacial surface 112 may be metallurgically bonded to the superabrasive body 102, and may have a substantially complementary surface geometry (e.g., overall planarity generally corresponding with the bonding surface 106, ignoring any periodicity of a pattern or surface feature therein). In an embodiment, the bonding surface 106 and the interfacial surface 112 may be configured as planar surfaces substantially across the entirety of each. In some embodiments, the bonding surface 106 and the interfacial surface 112 may extend generally perpendicularly to a longitudinal axis 101 of the superabrasive compact 100.

Superabrasive grains or materials for use in a superabrasive body 102 may include one or more of tungsten carbide, cubic boron nitride ("CBN"), diamond (e.g., polycrystalline diamond), or any other material having a hardness greater than tungsten carbide. For example, the superabrasive body 102 may include polycrystalline diamond ("PCD") having a plurality of directly-bonded-together diamond grains exhibiting diamond-to-diamond bonding (e.g., $sp^3$ bonding) therebetween. The superabrasive body 102, such as PCD, may also include a catalyst material (e.g., cobalt, iron, nickel, alloys thereof, or alkali metal carbonate catalysts or sintering by-products thereof) disposed in interstitial regions between the bonded grains (e.g., bonded diamond grains). In some embodiments, the catalyst material of the PCD may be fully or at least partially removed via, for example, acid leaching to form a so-called thermally stable PCD ("TSP") element.

Typically, formation of the superabrasive body 102 may include sintering a mass of superabrasive particles or powder (e.g., diamond powder) in the presence of a catalyst material (e.g., iron, cobalt, or nickel in the case of PCD) in an HPHT process. For example, U.S. Pat. No. 7,866,418 discloses suitable high-pressure sintering techniques and formulations for making superabrasive bodies having PCD. The disclosure of U.S. Pat. No. 7,866,418 is incorporated herein, in its entirety, by this reference. Upon sintering, the superabrasive particles may be bonded together to form bonded superabrasive grains having interstitial regions therebetween. The interstitial regions may include the catalyst material therein. The diamond particles used in the fabrication of the PCD may exhibit one or more selected sizes. The size of the particles refers to average size of the particles. The particles making up an average size may include a single mode of particles (e.g., substantially all particles are about the same size) or a bimodal, trimodal, or greater mixture of particles (e.g., a mixture of particles including two or more groups of particles each having a distinct average size or mode). The one or more selected sizes may be determined, for example, by passing the diamond particles through one or more sizing sieves or by any other sizing method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the diamond particles may also include three or more different (average) sizes (e.g., one relatively larger size and two or more relatively smaller sizes), without limitation. After sintering, the sintered superabrasive grains may exhibit the same or similar size distributions as the superabrasive particles.

The substrate 110 may include a cemented carbide substrate. The cementing constituent may include cobalt, iron, nickel, tungsten, titanium, chromium, niobium, tantalum, vanadium, or combinations thereof alloyed with iron, nickel, cobalt, or combinations of the foregoing. For example, in an embodiment, the substrate 110 may include cobalt-cemented tungsten carbide.

In an embodiment, the superabrasive body 102 may be integrally formed with (e.g., formed from diamond powder sintered on) the substrate 110 (e.g., sintered carbide substrate). In an embodiment, the superabrasive body 102 may be preformed (e.g., a preformed PCD table) in a first HPHT process and subsequently bonded to the substrate 110 in a second HPHT bonding process. A metallic constituent may be disposed in at least a portion of the interstitial regions and may be infiltrated primarily from the substrate 110 into the superabrasive body 102. Upon cooling, the infiltrated metallic constituent may act to bond the superabrasive body 102 to the substrate 110. In other embodiments, the metallic constituent may be provided from another source, such as disc of metal-solvent catalyst and/or metallic infiltrant.

Sintered PCD may exhibit a residual compressive stress. The residual compressive stress of the superabrasive body 102 is generally balanced by tensile stress in the substrate 110. In such embodiments under cutting conditions (e.g., elevated temperature and/or pressure), the mismatch in coefficients of thermal expansion of the interstitial material and the bonded superabrasive grains and/or residual stresses may cause cracking or delamination of the superabrasive body 102 from the substrate 110.

Figure 2A:
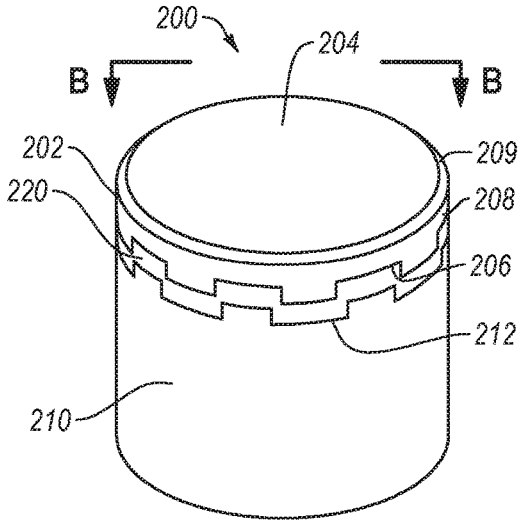
FIG. 2A is an isometric view of a superabrasive compact, according to an embodiment.
Figure 2B:
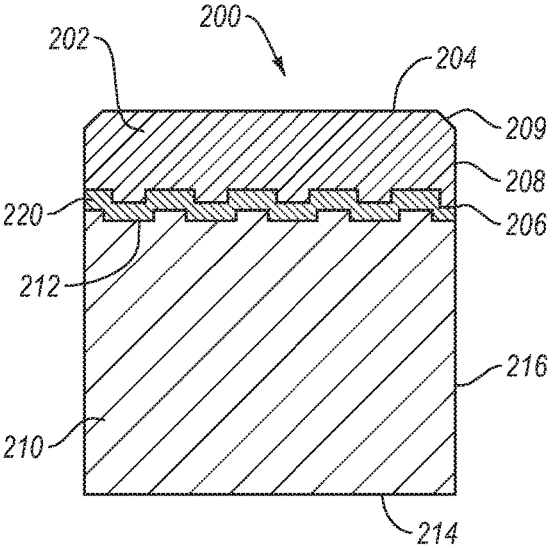
FIG. 2B is a cross-sectional view of the superabrasive compact of FIG. 2A taken along the plane B-B.

FIG. 2A is a cross-sectional view of a superabrasive compact 200, according to an embodiment. FIG. 2B is a cross-sectional view of the superabrasive compact 200 of FIG. 2A taken along the plane B-B. The superabrasive compact 200 or components thereof may be similar to the superabrasive compact 100 or components thereof, with like parts having identical numbering (e.g., the substrate 216 may be identical to the substrate 116 in one or more aspects). The superabrasive compact 200 includes a superabrasive body 202 (e.g., PCD table) similar to the superabrasive body 102. For example, the superabrasive body 202 may include an upper surface 204, a bonding surface 206 generally opposite to the upper surface 204, and a lateral surface 208 extending between the upper surface 204 and the bonding surface 206. Optionally, the superabrasive body 202 may include a chamfer 209 extending between the upper surface 204 and the lateral surface 208. The bonding surface 206 may be different from the bonding surface 106. For example, the bonding surface 206 may include a surface feature (e.g., one or more relieved, contoured, or patterned surfaces) therein. As explained in more detail below, the surface feature may include a plurality of raised and/or recessed contours or features, such as peaks, valleys, troughs, ridges, islands, depressions, waves, etc. The surface feature(s) may extend along at least a portion of the bonding surface 206.

The superabrasive compact 200 may include a substrate 210 similar to the substrate 110. For example, the substrate 210 may include an interfacial surface 212, a base surface 214 generally opposite to the interfacial surface 212, and a substrate lateral surface 216 extending between the interfacial surface 212 and the base surface 214. The interfacial surface 212 may be different from the interfacial surface 112. For example, the interfacial surface 212 may include a substrate surface feature (e.g., one or more relieved surfaces) therein. As explained in more detail below, the substrate surface feature(s) may include a plurality of raised and/or recessed contours or features, such as any of those noted above for the surface feature. The substrate surface feature(s) may extend along at least a portion of the interfacial surface 212. The substrate surface feature(s) may be substantially complementary to the surface feature in the body surface 206, such as having raised and recessed portions adjacent to the raised and recessed portions of the surface feature.

The superabrasive compact 200 includes a metallic member 220 disposed between the superabrasive body 202 and the substrate 210. In an embodiment, the metallic member 220 may be disposed between the bonding surface 206 and the interfacial surface 212. The metallic member 220 may interface with the bonding surface 206 and the interfacial surface 212. The metallic member 220 may extend into the raised and/or recessed contours or features of the surface feature and/or substrate surface feature (collectively "surface features"), thereby at least providing a mechanical joint having resistance to shear forces between the substantially complementary surface features of the superabrasive body 202 and the substrate 210. Such a shear-resistant joint may be manufactured without requiring HPHT processing and/or brazing processes to join the superabrasive body 202 to the substrate 210.

Superabrasive compacts including the shear-resistant joint may exhibit superior performance (e.g., less cracking or breakage) over superabrasive compacts having superabrasive bodies sintered or brazed to a substrate for a number of reasons. The lack of brazing may reduce or eliminate liquid metal embrittlement due to the reduced stresses in the interface between the superabrasive body 202 and the substrate 210. Thicker PCD bodies may be used due to the lack of a second sintering step, which second sintering conditions may produce detrimental stresses in the resulting sintered superabrasive body. Partially or fully leached PCD bodies may be used as the superabrasive body 202 in which the substantial removal of an interstitial constituent (e.g., cobalt or alloys thereof) therein may reduce or eliminate cracking or spalling due to the mismatch in coefficients of thermal expansion between PCD and the interstitial constituent. For example, the superabrasive body 202 may include a PCD table leached inwardly from the one or more exterior surfaces (e.g., one or more of the upper surface 204, the lateral surface 208, or the chamfer 209) to at least an intermediate depth therein, such as between the bonding surface 206 and the upper surface 204. In an embodiment, the superabrasive body 202 may include a substantially completely leached PCD table. Any of the embodiments of the superabrasive bodies herein may include an at least partially leached (e.g., a partially leached superabrasive body or a fully leached superabrasive body).

The metallic member 220 may include one or more metallic materials, such as copper, nickel, iron, aluminum, gold, silver, tin, titanium, tungsten, bismuth, lead, tantalum, zinc, zirconium, alloys of any of the foregoing, or combinations of any of the foregoing. In an embodiment, the metallic member 220 may include a ductile metallic material or braze material. Suitable braze materials may include one or more of boron, copper, aluminum, tin, silver, gold, nickel, silicon, tantalum, titanium, palladium, manganese, zinc, other metallic components, or alloys of any of the foregoing such as TiCuSil® or PALNICUROM® 10 which are currently commercially available from Wesgo Metals, Hayward, Calif. The metallic member 220 may substantially conform to the raised and/or recessed features of the surface feature or the substrate surface feature (e.g., fill the recesses and flow around the raised portions). For example, the metallic member 220 may include copper, wherein the copper may be heated to a temperature below the melting point of copper and pressed between the superabrasive body 202 and the substrate 210 causing the copper to deform (e.g., flow by force) into the recesses and around the raised portions thereof to substantially fill the recesses. In some embodiments, the metallic member 220 may flow into the surface features between the superabrasive body 202 and the substrate 210 without wetting the superabrasive body 202 or the substrate 210. In other embodiments, the metallic member 220 may flow into the surface features and may wet and/or react with the superabrasive body 202 and/or the substrate 210. Depending on the geometry of the raised and/or recessed features of the surface features, the metallic member 220 may provide a shear-resistant joint of a selected strength between the superabrasive body 202 and the substrate 210. The surface features may include one or more cross-sectional and/or lateral (e.g., planar) patterns.

Figure 2C:
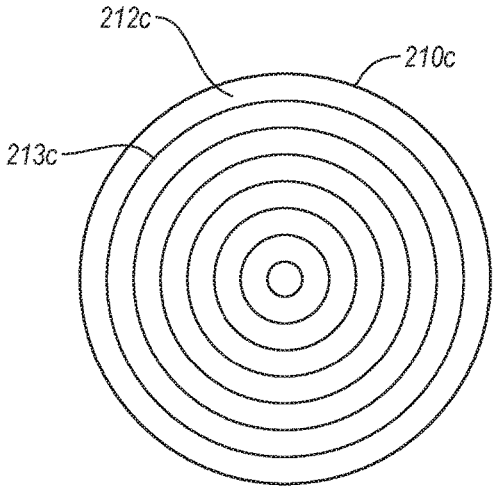
FIGS. 2C-2F are plan views of surface features of an interfacial surface of a substrate, according to various embodiments.
Figure 2D:
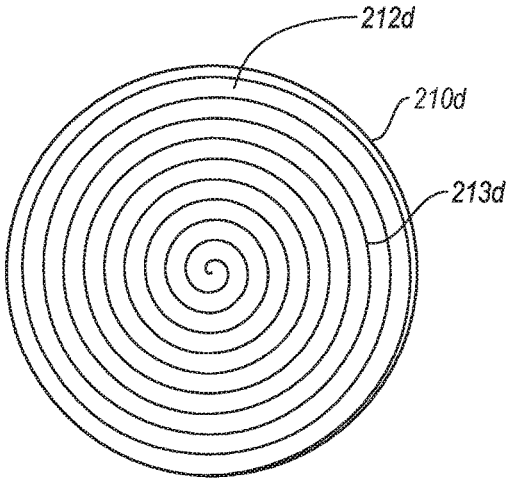
Figure 2E:
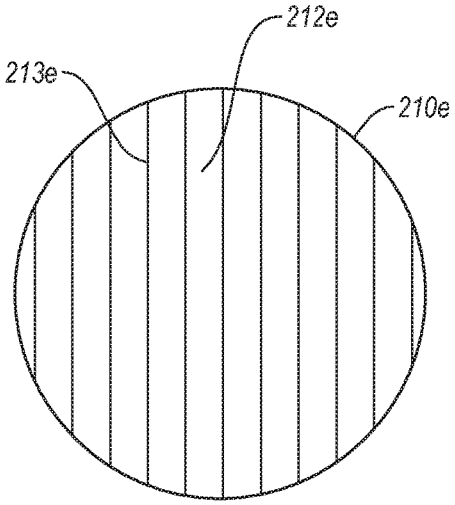

FIGS. 2C-2E are plan views of surface features of the interfacial surface of the substrate 210, according to various embodiments. While the plan views of FIGS. 2C-2E are discussed in terms of the interfacial surface of the substrate 210, generally any complementary or different patterns or any details associated therewith may be used in the bonding surface 206 of the superabrasive body 202, in any combination without limitation. While the patterns of the individual surface features are depicted with contours 213*c*-213*f* as lines, it is understood that the recesses and/or raised portions illustrated by the lines have a width or thickness, such as any of those disclosed herein (e.g., $W_L$ or $W_R$). The contours 213*c*-213*f* may be raised portions and/or recessed portions of the interfacial surface of a substrate.

FIG. 2C is a plan view of a pattern of a surface feature suitable for use in a bonding surface and/or an interfacial surface. The interfacial surface 212*c* of the substrate 210*c* is shown. In an embodiment, the substrate surface feature may include a pattern contours 213*c* forming concentric shapes. In an embodiment, the contours 213*c* forming concentric shapes may include raised portions and/or recessed portions. For example, the interfacial surface 212*c* may include a plurality of recessed concentric circles. In an embodiment, the contours 213*c* forming the concentric shapes may have differing depths, heights, and/or widths, such as at least about 100 μm deep, high, and/or wide or at least about 500 μm deep, high, and/or wide. In an embodiment, the contours 213*c* forming the concentric shapes may include one or more concentric raised features or recessed features having substantially the same shape. In an embodiment, the distance between each contour 213*c* forming a concentric shape may be the same or different. For example, each contour 213*c* may be offset from an adjacent concentric shape by about 200 μm or more, such as about 200 μm to about 1 mm, about 300 μm to about 600 μm, about 400 μm, about 500 μm, or about 380 μm. The center of the pattern of concentric shapes may be located substantially at the center or centroid of the interfacial surface 212*c* or away from the center of the interfacial surface 212*c*.

FIG. 2D is a plan view of a pattern of a surface feature suitable for use in a bonding surface and/or an interfacial surface. The interfacial surface 212*d* of the substrate 210*d* is shown. In an embodiment, the substrate surface feature may include a contour 213*d* having a spiral pattern. In an embodiment, the spiral may include raised portions and/or recessed portions. For example, the interfacial surface 212*d* may include a raised spiral. In an embodiment, the contour 213*d* forming the spiral may have differing depths, heights, and/or widths, such as at least about 100 μm deep, high, or wide, or at least about 500 μm deep, high, or wide. In an embodiment, the distance between each layer (e.g., overlapping revolution) of the spiral may be substantially equidistant or may vary, such as gradually increasing or decreasing. For example, each layer or ring of the spiral may be offset from an adjacent layer by about 200 μm or more, such as about 200 μm to about 1 mm, about 300 μm to about 600 μm, about 400 μm, about 500 μm, or about 380 μm. The center of the spiral may be located substantially in the center of the interfacial surface 212*d* or away from the center of the interfacial surface 212*d*.

FIG. 2E is a plan view of a pattern of a surface feature suitable for use in a bonding surface and/or an interfacial surface. The interfacial surface 212*e* of the substrate 210*e* is shown. In an embodiment, the substrate surface feature may include one or more contours 213*e* or bands (e.g., hatching) having a substantially linear arrangement. In an embodiment, the one or more contours 213*e* may include raised portions and/or recessed portions. For example, the interfacial surface 212*e* may include a plurality of recessed contours 213*e*. In an embodiment, the one or more contours 213*e* may have differing depths, heights, and/or widths, such as at least about 100 μm deep, high, or wide, or at least about 500 μm deep, high, or wide. In an embodiment, the one or more contours 213*e* may exhibit a linear configuration. In an embodiment, the one or more contours 213*e* may include an additional lateral component such as a wave (e.g., rounded or square wave) pattern, ziz-zag pattern, irregular (e.g., having substantially non-repeating) pattern, or combination of any of the foregoing. For example, the substrate surface feature may include a zig-zagged pattern including substantially identical parallel zig-zag contours.

In an embodiment, a direction along which the one or more contours 213*e* on the interfacial surface 212*e* extends may be substantially perpendicular to a longitudinal axis (see longitudinal axis 101 shown in FIG. 1A) of the superabrasive compact, which may provide increased shear resistance during cutting operations (e.g., as compared to planar interfaces). In an embodiment, a direction along which the one or more contours 213*e* on the interfacial surface 212*e* extend may be at least partially non-parallel and/or non-perpendicular to the longitudinal axis of the superabrasive compact, such as in a generally domed or other three-dimensional surface configuration. In an embodiment, a direction along which the one or more contours 213*e* on the interfacial surface 212*e* extend may be substantially perpendicular to one or more contours in the bonding surface of a corresponding superabrasive body. In an embodiment, a direction along which the one or more contours 213*e* on the interfacial surface 212*e* extend may be substantially parallel to one or more contours in the bonding surface of a corresponding superabrasive body. In an embodiment, the distance between each contour 213*e* of the one or more contours may be the same or different. For example, each contour 213*e* may be offset from an adjacent contour 213*e* by about 200 μm or more, such as about 200 μm to about 1 mm, about 300 μm to about 600 μm, about 400 μm, about 500 μm, or about 380 μm.

Figure 2F:
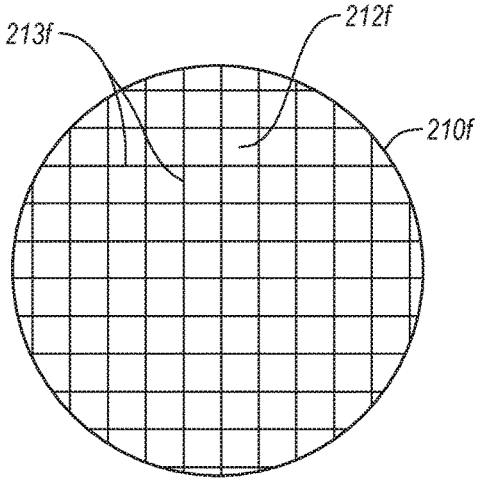

FIG. 2F is a plan view of a pattern of a surface feature suitable for use in a bonding surface and/or an interfacial surface. The interfacial surface 212*f* of the substrate 210*f* is shown. In an embodiment, the substrate surface feature may include cross-hatching formed by substantially perpendicular sets of contours 213*f*. The contours 213*f* may be similar or identical to those contours 213*e* described above. In an embodiment, the cross-hatching may include raised portions and/or recessed portions. For example, the interfacial surface 212*f* may include two or more sets of substantially perpendicular (e.g., perpendicular, oblique, or non-parallel intersecting contours) recessed contours 213*f* forming cross-hatching. In an embodiment, the interfacial surface 212*f* may include two sets of substantially perpendicular contours 213*f*; one set of contours 213*f* including raised features and the other set of contours including recessed features 213*f*, or combinations thereof. In an embodiment, the contours 213*f* may have differing depths, heights, and/or widths, such as at least about 100 μm deep, high, or wide, or at least about 500 μm deep, high, or wide. In an embodiment, the contours may exhibit a linear configuration. In an embodiment, the contours 213*f* may include a lateral component such as a wave pattern, ziz-zag pattern, irregular pattern, or combination of any of the foregoing. In an embodiment, the distance between each contour 213*f* of the one or more contours may be the same or different. For example, each contour 213*f* may be offset from an adjacent contour 213*f* by about 200 μm or more, such as about 200 μm to about 1 mm, about 300 μm to about 600 μm, about 400 μm, about 500 μm, or about 380 μm. In some embodiments, more than two sets of contours may be formed in a substrate or superabrasive body. The more than two sets of contours can be ordered in a pattern or can be randomly oriented with respect to each other.

In an embodiment, other surface features may include divots or recessed features (e.g., stippling), one or more raised islands (e.g., knurling or pyramidal shapes), irregular patterns (e.g., non-repeating, overlapping patterns of any of the above surface features), or combinations of any of the foregoing.

As shown in FIGS. 2A and 2B, the cross-sectional pattern of the surface features may form a square wave pattern. In some embodiments, cross-sectional patterns may vary. FIGS. 2G-2J are cross-sectional views of the surface feature patterns of superabrasive compacts according to various embodiments. The surface features therein depict side views of surface features having recesses or raised features that may constitute the contours 213*c*-213*f*.

Figure 2G:
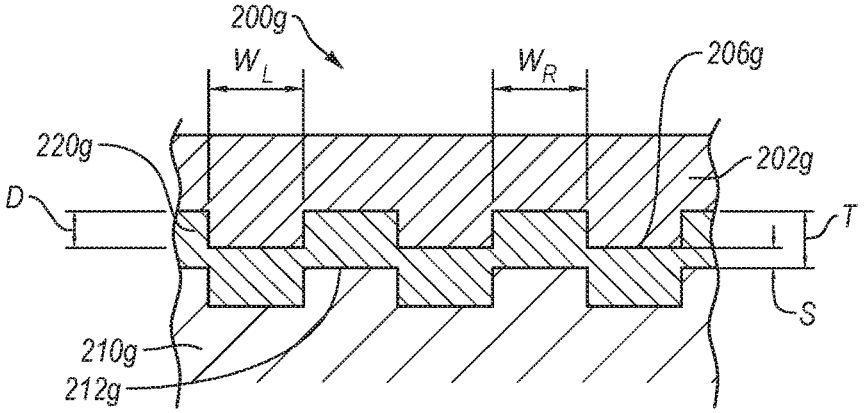
FIGS. 2G-2J are cross-sectional views of recess patterns of superabrasive compacts, according to various embodiments.

FIG. 2G is a cross-sectional view of a portion of a superabrasive compact 200*g*. The superabrasive compact 200*g* may include the superabrasive body 202*g*, the substrate 210*g*, and the metallic member 220*g*. The metallic member 220*g* may be disposed between the bonding surface 206*g* having a surface feature and the interfacial surface 212*g* having a substrate surface feature. The cross-sectional shape of the surface features may include squared recesses and/or raised lands (e.g., substantially square angles at the top of a land or bottom of a recess). For example, the surface feature may include a plurality of squared recesses. Each recess of the plurality of squared recesses may be substantially uniform or may be non-uniform. The plurality of squared recesses may include a depth D of about 100 μm or more, such as about 100 μm to about 1 mm, about 125 μm to about 500 μm, more than about 500 μm, less than about 500 μm, less than about 250 μm, or about 125 μm. The width $W_R$ of the squared recesses may be about 200 μm or more such as about 200 μm to about 1 mm, about 300 μm to about 600 μm, or about 380 μm. The width $W_L$ of the lands between the squared recesses may equal to, less than, or greater than the width $W_R$, such as about 200 μm or more, about 200 μm to about 1 mm, about 300 μm to about 600 μm, or about 380 μm. The interfacial surface 212*g* may have similar, identical, or different depths and/or widths as the bonding surface 206*g*. In some embodiments, the bonding surface 206*g* (e.g., the surface feature) and the interfacial surface 212*g* (e.g., the substrate surface feature) may be at least partially complementary, such as providing an at least partially staggered complementary arrangement between raised portions and recessed portions therebetween. In such embodiments, the metallic member 220*g* may flow therebetween with relatively little or modest lateral displacement of the material therein. In an embodiment, the depth D may be similar or identical to the depth of the recesses in the interfacial surface 212*g*. In an embodiment, the depth D may be different from the depth of the recesses in the interfacial surface 212*g*. Any of embodiments of surface features disclosed herein the recessed portions or raised portions may include any of the widths, depths, or other properties disclosed above and elsewhere herein, in any combination, without limitation.

In some embodiments, the thickness T of the metallic member 220*g* may exceed the depth D such that the opposing surface features do not extend beyond (e.g., register with) one another (e.g., substantially none of the surface features axially overlap any of the substrate (interfacial) surface features) when the metallic member 220*g* is positioned therebetween. For example, the thickness T may be about 100 μm or more, such as about 100 μm to about 1 mm, about 150 μm to about 500 μm, about 200 μm to about 400 μm, about 500 μm, more than about 250 μm, or about 300 μm. The thickness T may be selected to provide a standoff distance S between the closest points of the bonding surface 206*g* and the interfacial surface 212*g*, such as about 50 μm or more, about 50 μm to about 500 μm, about 100 μm to about 400 μm, or about 250 μm.

Figure 2H:
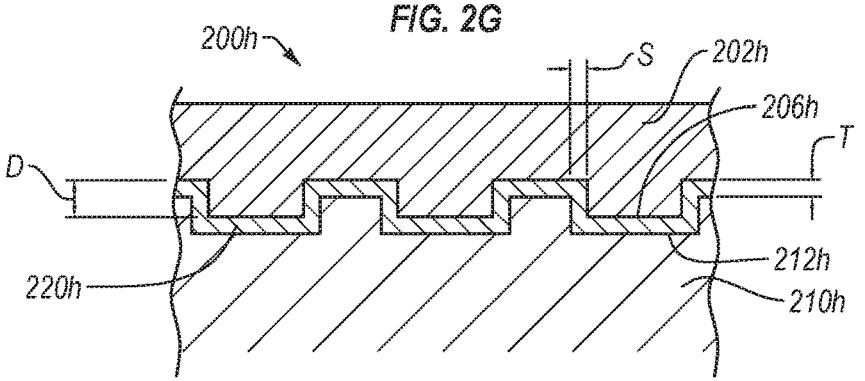

FIG. 2H is a cross-sectional view of a portion of a superabrasive compact 200*h* having substantially complementary surface features in the bonding surface 206*h* and the interfacial surface 212*h*. The superabrasive compact 200*h* may include the superabrasive body 202*h*, the substrate 210*h*, and the metallic member 220*h*. The metallic member 220*h* may be disposed between the bonding surface 206*h* having a surface feature and the interfacial surface 212*h* having a substrate surface feature. The cross-sectional shape of the surface features may include squared recesses and/or raised lands. The surface feature of the bonding surface 206*h* and the interfacial surface 212*h* may have matching or different cross-sectional geometries, respectively. For example, the bonding surface 206*h* may have a first square-wave pattern and the interfacial surface 212*h* may have a second square-wave pattern. The surface feature and the substrate surface feature may be at least partially complementary or substantially completely complementary (e.g., interlocking). For example, each raised feature of the bonding surface 206*h* may substantially align with a complementary recessed feature of the interfacial surface 212*h* and vice versa. In such embodiments, raised portions of the surface feature and recessed portions of the substrate surface feature may substantially laterally and/or axially align with each other. In an embodiment, the surface feature of the bonding surface 206*h* and the substrate surface feature of the interfacial surface 212*h* may be configured to at least partially be positioned (e.g., axially) within one another, which may at least partially resist lateral movement therebetween. For example, the width of the recesses in the bonding surface 206*h* may be wider than the width of the raised lands in the interfacial surface 212*h* and the width of the recesses in the interfacial surface 212*h* may be wider than the width of the raised lands in the bonding surface 206*h* and each may be positioned such that a portion of the interfacial surface 212*h* and the bonding surface 206*h* may at least partially axially overlap (e.g., each raised land may generally laterally align with a respective corresponding recess, as shown in FIG. 2H). In an embodiment, the thickness T of the metallic member may be an amount less than the depth D such that the opposing surface features axially overlap with one another (e.g., at least some of the surface features axially overlap at least some of the substrate surface features) to laterally interlock with each other. Such a configuration may inhibit or directly prevent lateral movement of the interfacial surface with respect to the bonding surface. For example, the thickness T may be about 50 μm or more, such as about 50 μm to about 1 mm, about 100 μm to about 500 μm, about 200 μm to about 400 μm, or about 300 μm. The thickness T may be selected to provide a standoff distance S between the closest points of the bonding surface 206*h* and the interfacial surface 212*h*, such as about 50 μm or more, about 50 μm to about 500 μm, about 100 μm to about 400 μm, or about 250 μm. In an embodiment, the standoff distance S may be substantially equal to the thickness T.

Figure 2I:
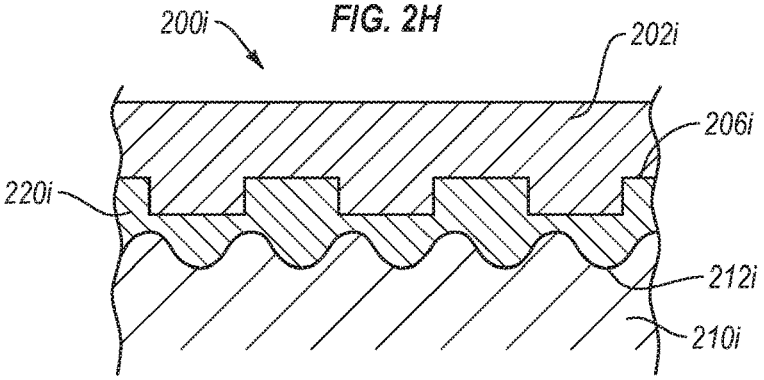

In some embodiments, the cross-sectional shape of the surface features may be different. FIG. 2I is a cross-sectional view of a portion of a superabrasive compact 200*i*. The superabrasive compact 200*i* may include the superabrasive body 202*i*, the substrate 210*i*, and the metallic member 220*i*. The metallic member 220*i* may be disposed between the bonding surface 206*i* having a surface feature and the interfacial surface 212*i* having a substrate surface feature. The cross-sectional shape of the surface feature of the bonding surface 206*i* and the substrate surface feature of the interfacial surface 212*i* may be configured with different cross-sectional patterns. For example, the surface feature may include squared recesses and/or raised lands and the interfacial surface feature may include a rounded wave (e.g., sinusoidal) pattern. In some embodiments, the surface features in the bonding surface 206*i* (e.g., the surface feature) and the interfacial surface 212*i* (e.g., the substrate surface feature) may be at least partially complementary, such as providing an at least partially staggered complementary arrangement between raised portions and recessed portions therebetween. The at least partially complementary surface features may be made without regard to the individual shapes of the raised or recessed portions between the bonding and interfacial surfaces, whether identical or different. In an embodiment, the surface features may be configured at least partially fit within or not fit within one another. The metallic member 220*i* may at least partially conform to both of the surface features. Such a configuration may provide a shear-resistant joint therebetween.

Figure 2J:
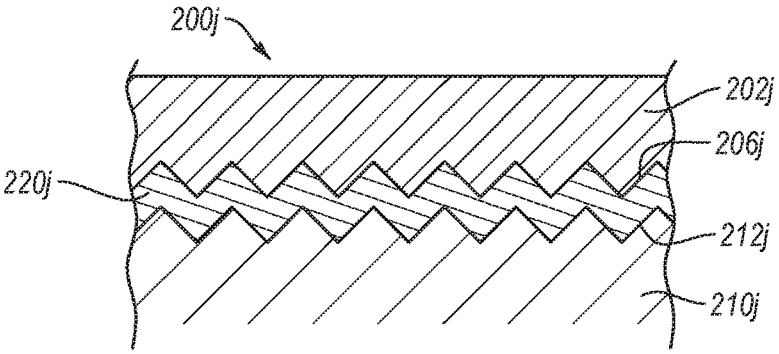

Further cross-sectional patterns may include an irregular pattern (e.g., non-uniform and/or non-repeating recesses or raised portions), islands, recesses, protrusions (e.g., knurling or protruding three dimensional shapes), angular grooves or ridges (e.g., forming a zig-zag path or other selected path), or contours. FIG. 2J is a cross-sectional view of a portion of a superabrasive compact 200*j*. The superabrasive compact 200*j* may include the superabrasive body 202*j*, the substrate 210*j*, and the metallic member 220*j*. The metallic member 220*j* may be disposed between the bonding surface 206*j* having a surface feature and the interfacial surface 212*j* having a substrate surface feature. The cross-sectional shape of the surface feature of the bonding surface 206*j* and the substrate surface feature of the interfacial surface 212*j* may be configured with a repeating triangular cross-sectional pattern. For example, the surface features may include angled recesses and/or raised lands, such as having oblique angles with respect to the overall plane (e.g., ignoring the surface feature) of the surfaces on which or into which the surface features are formed. In some embodiments, the surface features in the bonding surface 206*j* and the interfacial surface 212*j* may be at least partially complementary. In an embodiment, the surface features may be configured at least partially axially overlap or not to axially overlap. The metallic member 220*j* may at least partially conform to both of the surface features, which may provide a shear-resistant joint therebetween.

While shown as substantially planar—ignoring the surface features (e.g., the periodicity of the square-wave, recess, or ridge)—the bonding surface and/or the interfacial surface may exhibit a curvature or other geometry (e.g., such as a large step or depression), in addition to the surface feature therein. For example, the interfacial surface may exhibit a generally domed curvature in addition to the pattern of the substrate surface feature therein. Optionally, the bonding surface may exhibit a substantially complementary or a slightly different curvature or other geometry. In an embodiment, the metallic member may include a thickness sufficient to separate the bonding surface and the interfacial surface along substantially the entirety of each surface to accommodate any differences in curvature between the bonding surface and the interfacial surface. In an embodiment, the bonding surface and the interfacial surface may be slightly non-parallel to one another. For example, the bonding surface and the interfacial surface may exhibit an angle therebetween of about 10 degrees or less, wherein the metallic member is configured with a thickness sufficient to provide a selected gap between the non-parallel surfaces (e.g., when heated and/or pressed together). In an embodiment, the selected gap may be configured to cause the upper surface to be substantially parallel or non-parallel to the base surface.

Figure 3:
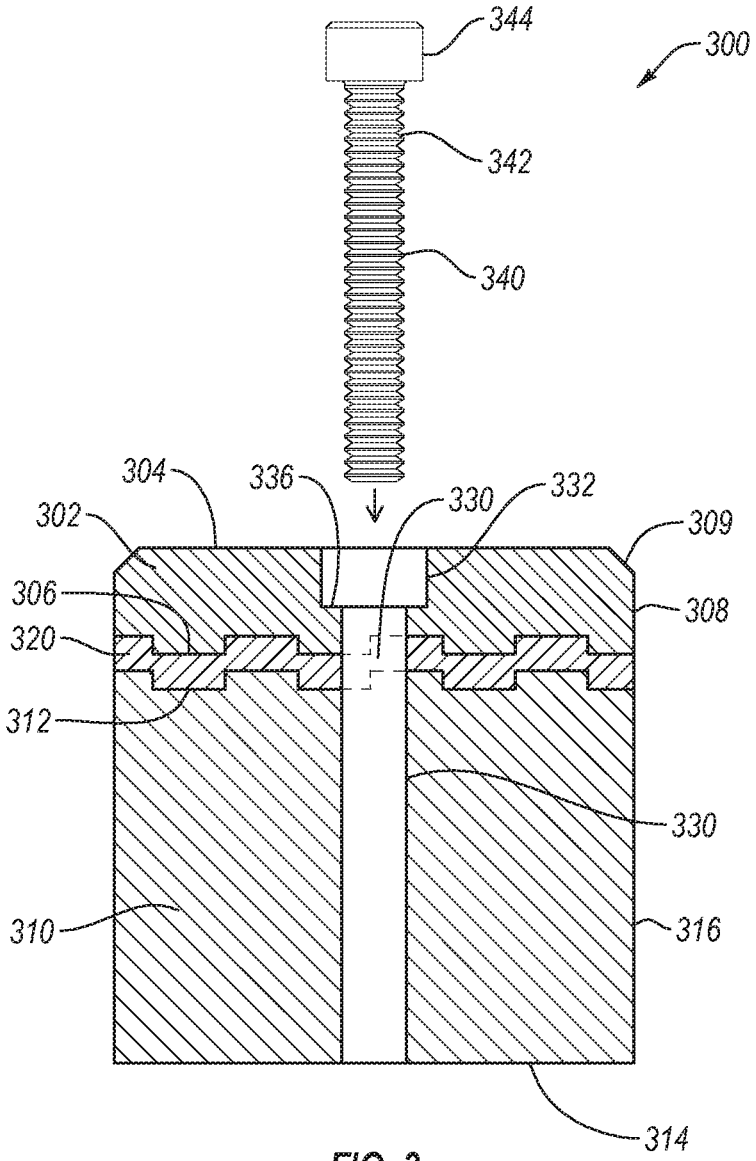
FIG. 3 is a cross-sectional view of a superabrasive compact having a hole therethrough, according to an embodiment.

In some embodiments, retaining member may be used to provide additional bonding strength between the superabrasive body and the substrate and/or the superabrasive compact and a cutter bit assembly or bit body of a drill bit. FIG. 3 is a cross-sectional view of a superabrasive compact 300 having a hole therethrough for use with an additional retaining member, according to an embodiment. The superabrasive compact 300 or components thereof may be similar or identical to the superabrasive compact 200 or components thereof, with like parts having like numbering (e.g., the substrate 310 may be identical to the substrate 210 in one or more aspects). The superabrasive compact 300 may include a superabrasive body 302 similar or identical to the superabrasive body 202. For example, the superabrasive body 302 may include an upper surface 304, a bonding surface 306 generally opposite to the upper surface 304, and a lateral surface 308 extending between the upper surface 304 and the bonding surface 306. Optionally, the superabrasive body 302 may include a chamfer 309 extending between the upper surface 304 and the lateral surface 308. The bonding surface 306 may include a surface feature therein, such as any surface feature disclosed herein.

The superabrasive compact 300 may include a substrate 310 similar or identical to the substrate 210. For example, the substrate 310 may include an interfacial surface 312, a base surface 314 generally opposite to the interfacial surface 312, and a substrate lateral surface 316 extending between the interfacial surface 312 and the base surface 314. In an embodiment, the interfacial surface 312 may be different from the bonding surface 306.

The superabrasive compact 300 may include a hole 330 extending therethrough. The hole 330 may include a plurality of holes 330 in each of the superabrasive body 302, the substrate 310, and the metallic member 320. The plurality of holes 330 may be aligned (e.g., generally along an axial direction, as shown in FIG. 3) such that a retaining member such as a fastener 340 (e.g., screw or bolt) may be inserted therethrough, when the superabrasive body 302, the substrate 310, and the metallic member 320 are assembled into the superabrasive compact 300. The hole 330 may exhibit any diameter sufficient to accommodate a fastener, rod, rivet, or pin therein. For example, the hole 330 may exhibit a diameter of about 2 mm or more, such as about 2 mm to about 15 mm, about 2 mm to about 5 mm, about 5 mm to about 10 mm, about 3 mm, about 6 mm, about 9 mm, or about 12 mm. The fastener 340 may include a shank or shaft 342 and a head 344.

In an embodiment (not shown), the hole 330 may include threading therein. The shaft 342 of the fastener 340 may include threading complementary to the threading in the hole 330, such that the fastener 340 may thread into the hole 330, which may bias the superabrasive body 302 against the substrate 310. In some embodiments, the superabrasive body 302 may include a counterbored hole 332 configured to accommodate the head 344 of the fastener 340. The counterbored hole 332 may exhibit a larger diameter than the hole 330, such that a head 344 of a fastener larger than the shaft 342 may be accommodated therein. The counterbored hole 332 may be at least partially axially aligned or substantially concentric with the hole 330. For example, the counterbored hole 332 may exhibit a substantially concentric alignment with the hole 330. The counterbored hole 332 may extend from the upper surface 304 of the superabrasive body 302 toward the bonding surface 306 to an intermediate point 336 therebetween. The holes 330 and/or the counterbored hole 332 may be defined by sidewalls extending substantially perpendicular to the upper surface 304. The counterbored hole 332 may be defined by substantially straight sidewalls or angled side walls (not shown). The counterbored hole 332 may provide a surface upon which the head of the fastener 340 may apply a bias or force, thereby biasing the superabrasive body 302 against the metallic member 320 and toward the substrate 310. In an embodiment, the head 344 of the fastener 340 may be configured to fit entirely within the counterbored hole 332 (e.g., such that the head 344 does not protrude above the upper surface 304 of the superabrasive body 302. In an embodiment, the fastener 340 may extend through the superabrasive compact 300 and into a fixture or mounting medium, and the fastener 340 may bias or force the superabrasive compact 300 against one or more surfaces of the fixture or mounting medium. In an embodiment (not shown), an additional metallic member (e.g., a washer) may be positioned between the head 344 of the fastener 340 and the intermediate point 336 in the counterbored hole 332. Such a configuration may provide a ductile and/or larger contact area between the head 344 and the superabrasive body 302, which may limit cracking of the superabrasive body 302. The additional metallic member may be similar to first metallic member, such as having a composition similar or identical to any metallic member disclosed herein. While described as counterbored, the counterbored hole 332 or the holes 330 may include countersunk holes and may be formed by any suitable technique such as countersinking, counterboring, milling, lasing, or grinding.

Figure 4A:
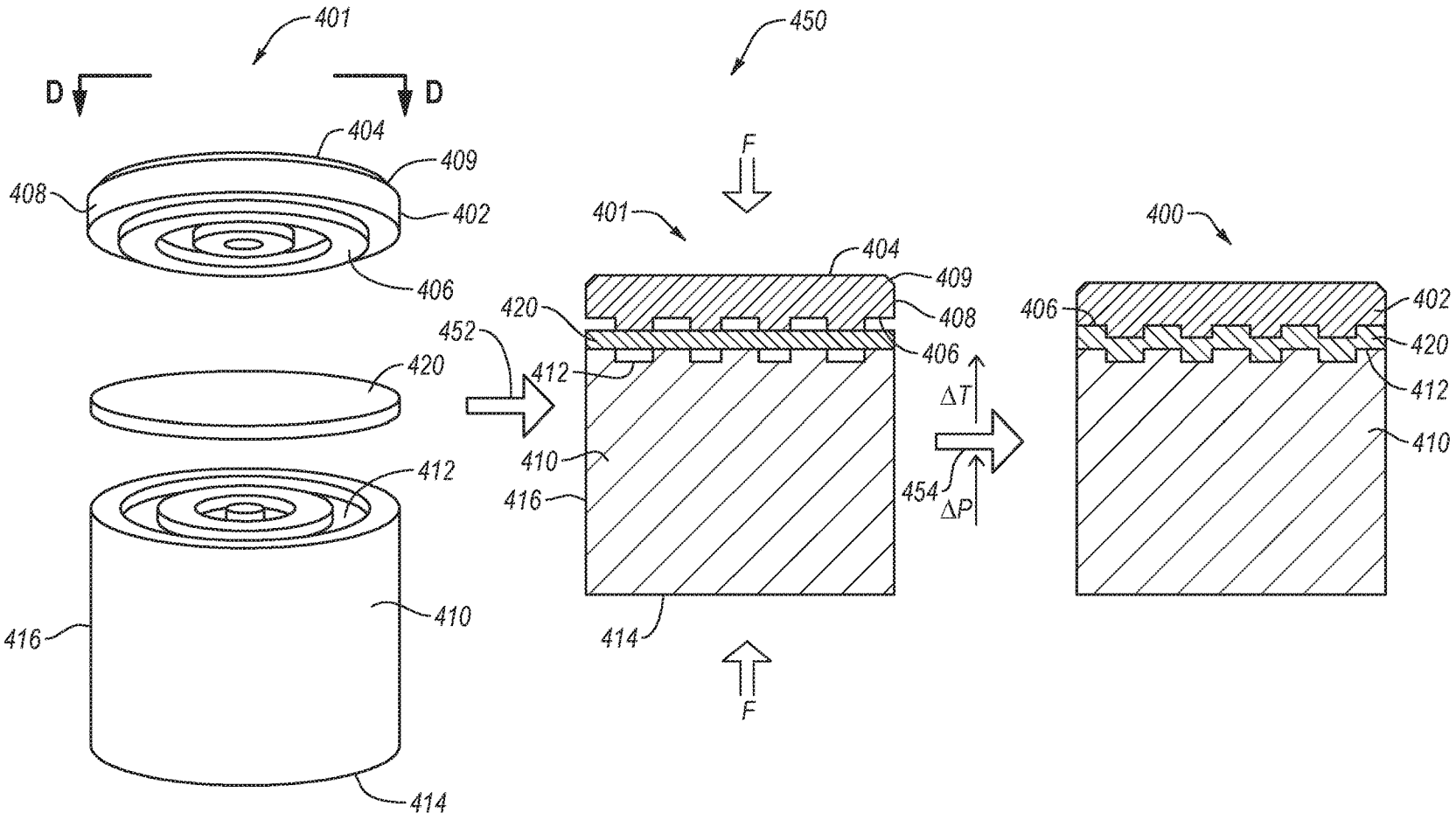
FIG. 4A is a schematic flow diagram of a method of making a superabrasive compact, according to an embodiment.
Figure 4B:
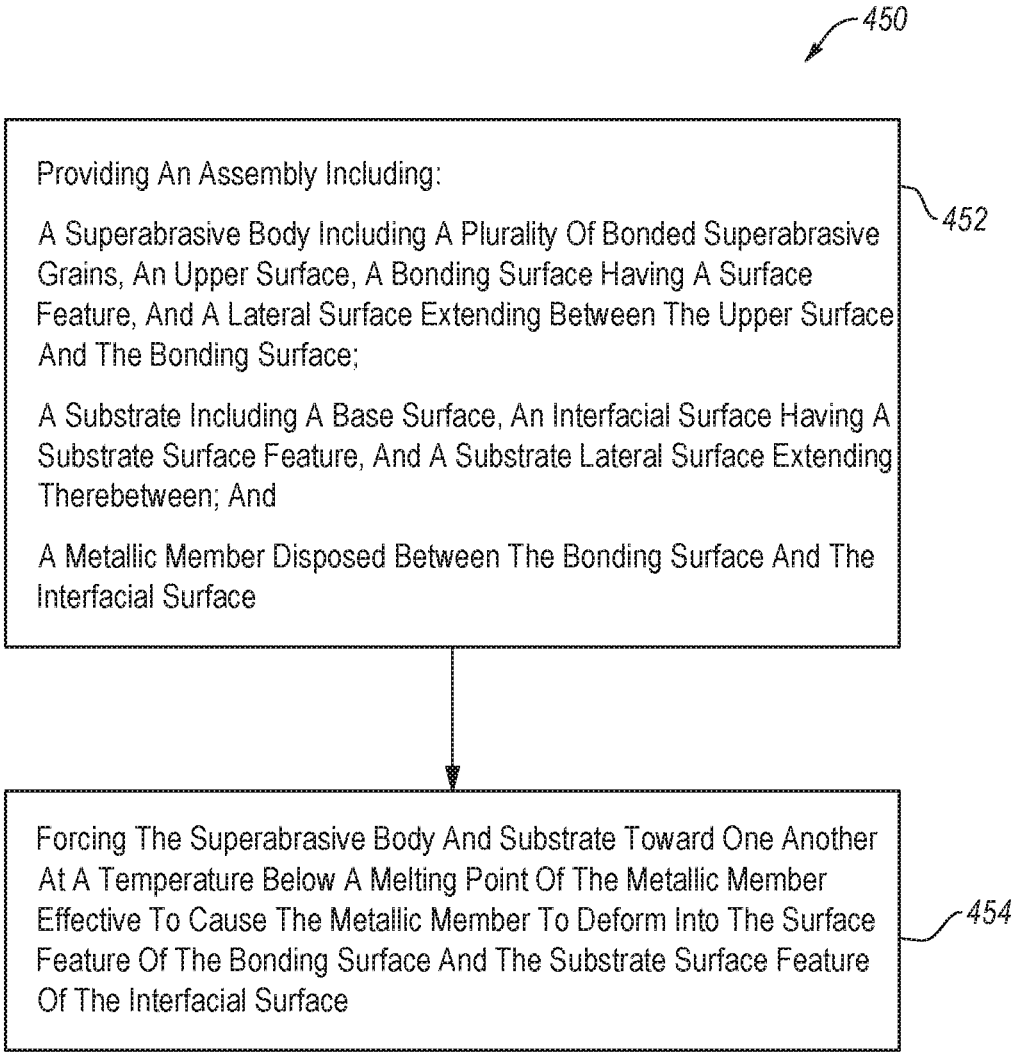
FIG. 4B is a flow chart of a method of making a superabrasive compact, according to an embodiment.

FIG. 4A is a schematic flow diagram of a method 450 of making a superabrasive compact 400 according to an embodiment. FIG. 4B is a flow chart of the method 450 of making a superabrasive compact 400. The method 450 may include the act 452 of providing an assembly 401. The assembly 401 may include a superabrasive body 402, a substrate 410, and a metallic member 420. The method may further include an act 454 of forcing the superabrasive body 402 toward the substrate 410 to deform the metallic member 420 such that the metallic member 420 substantially conforms to surface features formed in the superabrasive body 402 and/or the substrate 410. The superabrasive body 402, substrate 410, or metallic member 420 may be similar or identical to any superabrasive body, substrate, or metallic member disclosed herein including any configurations, compositions, or properties associated therewith.

For example, the superabrasive body 402 may include an upper surface 404, a bonding surface 406, a lateral surface 408 extending between the upper and bonding surfaces 404 and 406, and an optional chamfer 409. The bonding surface 406 may include a surface feature therein. The upper surface 404, bonding surface 406, lateral surface 408, or surface feature may be similar or identical to any an upper surface, a bonding surface, and lateral surface, or surface feature disclosed herein. For example, the surface feature in the bonding surface 406 may include recessed concentric circles. The substrate 410 may include a base surface 414, an interfacial surface 412, and a substrate lateral surface 416 therebetween. The base surface 414, interfacial surface 412, and/or substrate lateral surface 416 may be similar or identical to any base surface, interfacial surface, and/or substrate lateral surface disclosed herein. The interfacial surface 412 may include a substrate surface feature similar or identical to any substrate surface feature disclosed herein. The metallic member 420 may be similar or identical to any metallic member disclosed herein, including any composition, configuration, or property thereof.

The act 452 of providing an assembly may include positioning the metallic member 420 adjacent to (e.g., on top of) the interfacial surface 412 of the substrate 410. The act 452 of providing an assembly may include positioning the superabrasive body 402 adjacent to the metallic member 420, such as positioning the bonding surface 406 adjacent to (e.g., on top of) the metallic member 420. The act 452 of providing an assembly may include forming a surface feature in the interfacial surface 412 and/or the bonding surface 406, such as by molding, lasing, milling, grinding, lapping, electro-discharge machining ("EDM") (e.g., sinker or wire EDM). The act 452 of providing an assembly may include positioning the assembly 401 in a container (not shown) configured to hold each member of the assembly 401 in alignment (e.g., a refractory metal can). The act 452 of providing an assembly may include forming one or more holes in each one or more of the superabrasive body 402, the substrate 410, or the metallic member, such as an axially aligned hole similar or identical the hole 330 disclosed above. The act 452 of providing an assembly may include forming one or more counterbored holes the superabrasive body 402, such as a counterbored hole similar or identical the counterbored hole 332 disclosed above (e.g., substantially concentric with the holes in the metallic member and substrate). Forming the one or more holes or counterbored hole may be carried out by molding, lasing, milling, grinding, lapping, EDM, or any other suitable method.

The method 450 may include the act 454 of subjecting the assembly 401 to forces F (e.g., compressive forces) sufficient to cause the metallic member 420 to deform between the bonding surface 406 and the interfacial surface 412 to conform to the surface features of each. Optionally, subjecting the assembly to forces F sufficient to cause the metallic member 420 to deform may be done below the melting point of the metallic member. In an embodiment, subjecting the assembly 401 to forces F sufficient to cause the metallic member 420 to deform may include forcing the superabrasive body and substrate toward one another at a temperature below a melting point of the metallic member effective to cause the metallic member to deform into one or more of the surface features in the bonding surface and the substrate surface features in the interfacial surface. For example, as used herein, "melting point" or "melting temperature" is a temperature at which the metallic member 420, other metallic member disclosed herein, or a component thereof begins to melt. When the metallic member 420 or other metallic member is an alloy (e.g., in an alloy having a hyper- or hypo-eutectic composition), the alloy melts over a temperature range instead of at a single temperature as occurs in a pure metal. In an embodiment, subjecting the assembly 401 to forces F and/or a temperature below the melting point of the metallic member 420 may include subjecting the assembly to forces F (e.g., compressive forces) of about 1000 lbs. or more, such as about 1000 lbs. to about 3000 lbs., about 2000 lbs. to about 5000 lbs., about 3000 lbs. to about 10,000 lbs., about 5000 lbs. to about 10,000 lbs., about 5000 lbs., about 10,000 lbs. or more, about 20,000 lbs. or less, or more than about 20,000 lbs. In an embodiment, subjecting the assembly 401 to forces F and/or a temperature below the melting point of the metallic member 420 may include subjecting the assembly to a temperature of about 90% or less of the melting point of the metallic member 420 (e.g., the temperature at which the alloy begins to melt), such as about 90% to about 40%, about 80% to about 60%, about 50%, about 60%, about 75%, about 80%, or about 90% of the melting temperature of the metallic member 420. In an embodiment, the temperature may be about 800° C. or less, such as about 800° C. to about 200° C., about 600° C. to about 400° C., about 700° C. to about 500° C., or less than about 650° C. In an embodiment, the temperature may be selected and/or elevated such that the metallic member 420 does not wet and/or diffuse into the substrate or the superabrasive body (e.g., into the interstitial spaces therein). The act of subjecting the assembly 401 to forces F and/or a temperature below a melting point of the metallic member 420 may be carried out in an ambient environment, in an inert environment (e.g., nitrogen or argon atmosphere), or under vacuum.

In another embodiment, the metallic member 420 may be selected and configured to be at least partially brazed to and/or wet (e.g., at act 452 in FIG. 4A) one or more of the interfacial surface or the bonding surface and then may be deformed (e.g., pressed) to fit in the surface features thereof. In such embodiments, the metallic member 420 or a component thereof may partially wet or completely wet one or more of the interfacial surface or the bonding surface, but still remain relatively thick, sufficient to separate the interfacial surface from the bonding surface. For example, the metallic member 420, having a wetting component therein, can exhibit a thickness (e.g., after wetting or brazing) of about 500 μm or more, such as about 500 μm to about 1.25 mm, about 1.25 mm to about 2.5 mm, about 2.5 mm to about 5.0 mm, more than about 5.0 mm, or less than about 5.0 mm. In an embodiment, subjecting the assembly 401 to forces F and/or a temperature below the melting point of the metallic member may include pressing the assembly in a press (e.g., a High-Pressure/High-Temperature cubic press, or a conventional hydraulic press) prior to, simultaneously with, or after heating the assembly to the elevated temperature. For example, the assembly may be pressed and then may be heated while under compressive force F from the press. Such force F can include relatively high pressures of about 2 GPa or more, such as about 4 GPa to about 8 GPa, about 5 GPa to about 10 GPa, about 7 GPa to about 14 GPa, about 7 GPa or more, about 10 GPa or less. In some embodiments, a relatively low pressure may be used in the press such as about 0.1 GPa or more, about 0.1 GPa to about 2 GPa, about 1 GPa to about 2 GPa, about 1.5 GPa, about 2 GPa or less, or about 2 GPa. Such heating may include inductive heating or heating in an oven. Subjecting the assembly 401 to forces F and/or a temperature below the melting point of the metallic member may include increasing the temperature at a selected rate while the assembly is under load in the press. Subjecting the assembly 401 to forces F and/or a temperature (e.g., below the melting point of the metallic member) may include heating the assembly or portions thereof in an oven prior to pressing. Subjecting the assembly 401 to forces F and/or a temperature (e.g., below the melting point of the metallic member) may further include cooling the assembly down from the maximum temperature applied thereto, such cooling may occur while the assembly is under a load in the press or not under a load outside of the press.

In some embodiments, the resulting superabrasive body 402 may be leached to at least partially remove interstitial constituents therefrom, such as after the assembly has been subjected to forces F and/or a temperature. For example, the superabrasive body 402 may be disposed in an acidic solution composed to remove metal-solvent catalyst (e.g., cobalt) therefrom. Leaching can include any of the leaching techniques disclosed in U.S. patent application Ser. Nos. 12/555,715; 13/324,237; 13/751,405, each of which is incorporated herein, by this reference in its entirety. In some embodiments, the metallic member 420 and/or the substrate 410 may be masked or not exposed to the leaching agent(s).

In an embodiment, a method of making a superabrasive compact may include biasing the superabrasive body against the metallic member and the substrate with a retaining member. For example, in an embodiment, the retaining member may include a fastener such as a bolt; and the superabrasive body 402, the metallic member 420, and the substrate 410 may each include a counterbored hole configured to accommodate the fastener. The fastener may protrude entirely through the substrate and be tightened with a nut on the end opposite the head to bias the head of the fastener against the superabrasive body which may bias the superabrasive body against the metallic member and toward the substrate. In an embodiment, the substrate may have threading therein, and the fastener may have a complementary threading, whereby the fastener may be tightened (e.g., rotated or screwed) into the threading of the substrate, which may bias the superabrasive body against the metallic member and toward the substrate.

In an embodiment, biasing the superabrasive body against the metallic member with the retaining member may include clamping the superabrasive body against the metallic member, substrate, and/or a bit assembly. For example, a clamp may be employed to provide a clamping force on the upper surface of the superabrasive body. In an embodiment, the clamping force may be applied on the upper surface toward the substrate base surface. A clamp suitable for securing a superabrasive body to a metallic member and substrate may be included on a drill bit. The clamp may also be configured to secure the superabrasive compact to the drill bit.

Figure 5A:
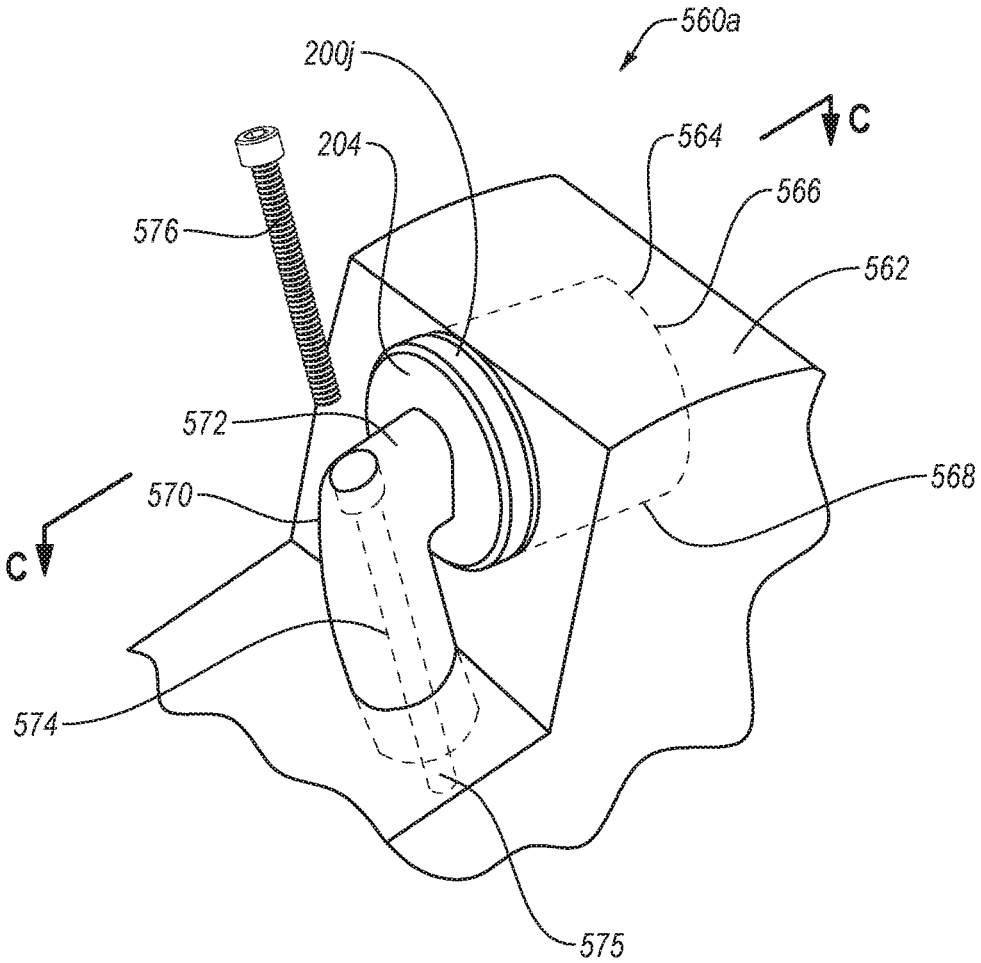
FIG. 5A is an isometric view of a portion of a bit body, according to an embodiment.
Figure 5B:
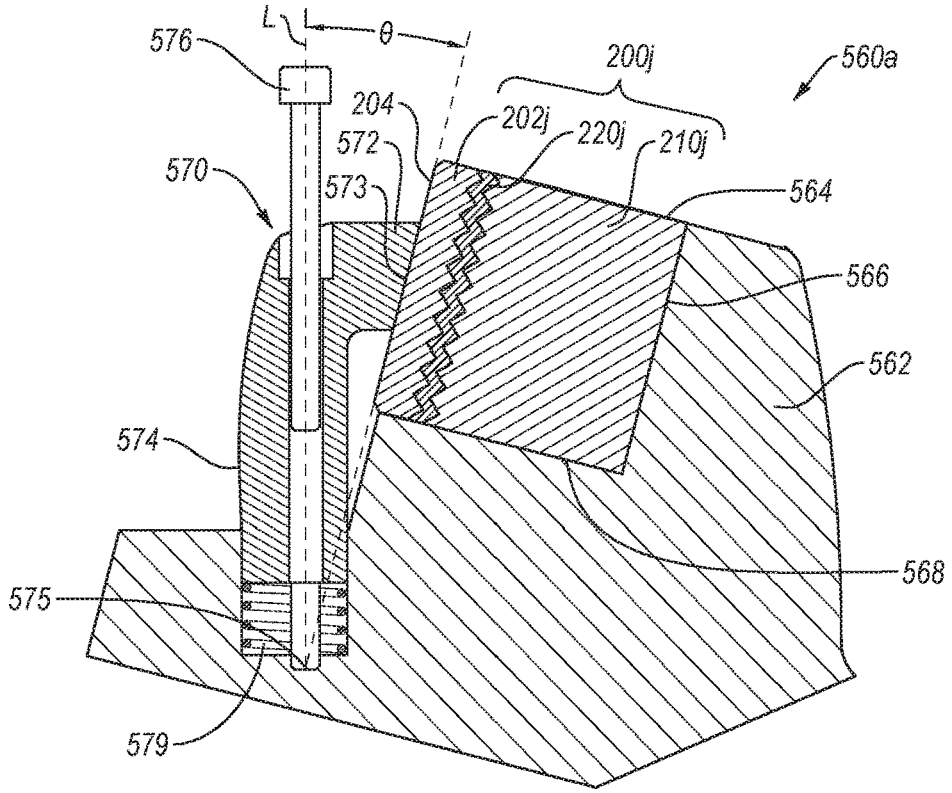
FIG. 5B is a cross-sectional view of the bit body of FIG. 5A taken along the plane C-C.

FIG. 5A is an isometric view of a portion of a cutter bit assembly 560*a* of a drill bit body according to an embodiment. FIG. 5B is a cross-sectional view of the cutter assembly 560*a* of FIG. 5A taken along the plane C-C thereof. A drill bit body may include one or more cutter bit assemblies 560*a*. The cutter bit assembly 560*a* may include a portion of the bit body 562 having a cutter pocket 564 therein and at least one retaining member, such as a clamp 570. The cutter pocket 564 may be sized and configured to hold a cutting element therein. The cutting element may be a superabrasive compact such as any superabrasive compact disclosed herein. For example, the cutting element may be configured as a superabrasive compact 200*j* which may be disposed within the cutter pocket 564.

The cutter pocket 564 may include a back wall 566 and a seat 568. The back wall 566 and the seat 568 may be substantially perpendicular to each other. The back wall 566 may be configured to contact the base surface of the substrate 210*j* and the seat 568 may be configured to support the lateral surface of the substrate 210*j* and the superabrasive body 202*j*. The cutter pocket 564 may be configured such that the cutting element therein at least partially protrudes therefrom. For example, the cutter pocket 564 may extend into the bit body 562 at an oblique angle configured to cause at least a portion of the superabrasive body (e.g., chamfer) to protrude beyond the bit body 562 to allow the cutting element to contact a subterranean formation upon rotation of the drill bit and also to limit contact of the bit body 562 with the subterranean formation.

The at least one retaining member may include the clamp 570. The clamp 570 may be partially disposed within the bit body 562 adjacent to the upper surface of the cutting element in the cutter pocket 564. For example, an arm 574 of the clamp 570 may extend into the bit body 562 such is into a recess formed therein. The recess may exhibit a depth sufficient to allow the arm 574 to extend therein without reaching the bottom thereof. The recess in bit body 562 may further include a threaded hole 575 therein. The threaded hole 575 may be in axial alignment with a hole in the arm 574 which may be threaded or un-threaded. A clamp fastener 576 having complementary threading may be disposed in the threaded hole 575, such that tightening of the clamp fastener 576 in the threaded hole 575 of the bit body 562 places a downward force on the arm 574. A contact pad 572 may be positioned on the arm 574. The contact pad 572 may extend substantially perpendicular from the arm 574 toward the upper surface 204 of the superabrasive compact 200*j*. The contact pad 572 may include a pressure surface 573 configured to contact the upper surface 204 of the superabrasive body 202*j* (e.g., at a substantially parallel angle to the upper surface 204 and at an oblique angle θ with respect to the longitudinal axis L of the arm 574), such that tightening of the arm 574 may apply pressure against the upper surface 204 in one or more of a downward (e.g., toward the seat 568) or backward (e.g., toward the back wall 566) direction. The recess in the bit body 562 may exhibit a depth sufficient to allow the arm 574 to extend therein without reaching the bottom of the recess. In such embodiments, the contact pad 572 may adjustably contact the upper surface 204 of superabrasive compacts of various heights without bottoming out the arm 574 in the recess. In such embodiments, as the contact pad 572 contacts the upper surface 204, the arm 574 is prevented from being lowered farther into the recess. The clamp fastener 576 may be tightened (e.g., torqued) to prevent slippage or loosening of the superabrasive compact 200*j* in the bit assembly 560*a*. Optionally, the recess may include a biasing member 579 therein (e.g., in the bottom of the recess). For example, the biasing member 579 may include a compression spring, a resilient tubular piece of material (e.g., rubber), a spring washer, any suitable biasing member, or combinations thereof. The force exerted on the upper surface 204 by the clamp 570 is equal to the downward force exerted on the arm 574 (e.g., via the fastener 576) divided by the sin(θ). In some embodiments, the angle θ may be about 5 degrees or more, such as about 5 degrees to about 45 degrees, about 10 degrees to about 35 degrees, about 5 degrees to about 15 degrees, about 15 degrees to about 30 degrees, about 20 degrees, or less than about 45 degrees. In some embodiments, the clamp 570—including the arm 574, the contact pad 572, or the clamp fastener 576—may be configured to provide clearance for the superabrasive compact (cutting element) 200*j* (e.g., at least a portion of the upper surface, lateral surface, or chamfer) to contact an oncoming formation (e.g., rock) upon rotation of the drill bit and also to limit contact of the clamp 570—including the arm 574, the contact pad 572, or the clamp fastener 576—with the subterranean formation.

Figure 5C:
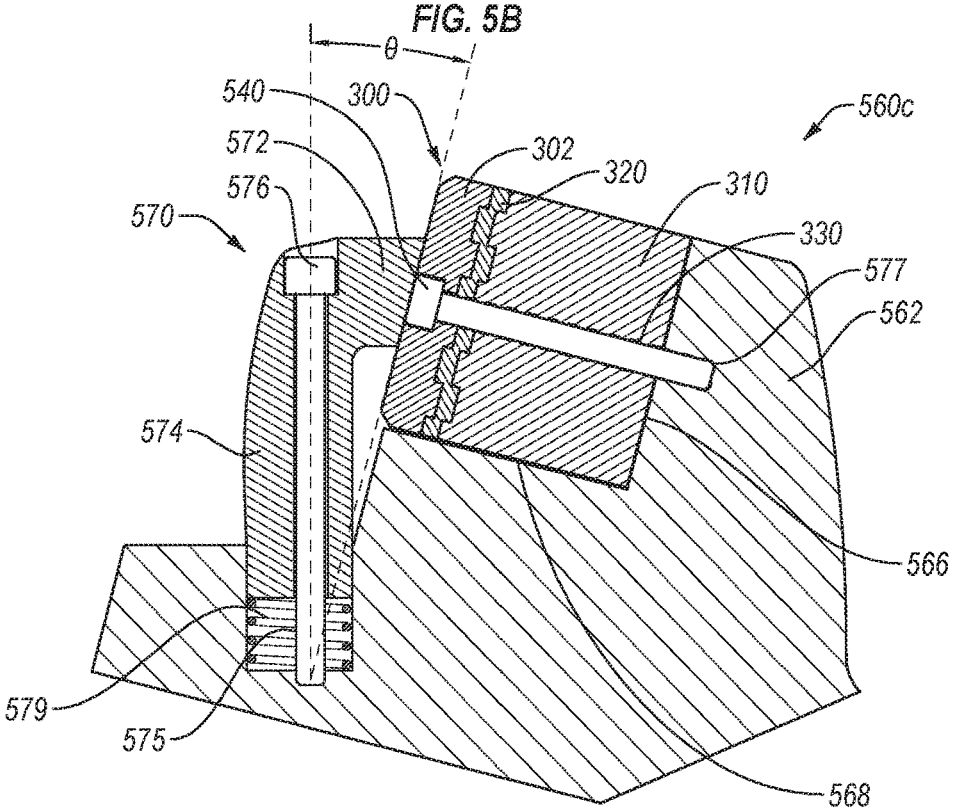
FIG. 5C is a cross-sectional view of a portion of a bit body, according to an embodiment.

In an embodiment, more than one retention member may be used to hold a cutting element in a bit assembly. FIG. 5C is a cross-sectional view of a portion of cutter bit assembly 560*c* of a bit body according to an embodiment. The cutter bit assembly 560*c* may be similar or identical to the cutter bit assembly 560*a* in one or more aspects, with identical parts having identical numbering. For example, the cutter bit assembly 560*c* may include a portion of the bit body 562 having a cutter pocket 564 therein and at least one retaining member, such as the clamp 570. The cutter pocket 564 may be sized and configured to hold a cutting element therein. The cutter bit assembly 560*c* may also include a second retention member, such as a bit fastener 540. The bit fastener 540 may be configured to be disposed in a retention hole 577 and apply a clamping force on cutting element against/toward the back wall 566. For example, the cutter bit assembly 560*c* may include the retention hole 577 in the back wall 566. The retention hole 577 may be axially aligned with one or more holes in the cutting element. In an embodiment, the retention hole 577 may be a terminal hole (e.g., a hole terminating in the bit body). In an embodiment, the cutting element may be similar or identical to the superabrasive compact 300 with like parts having like numbering. For example, the cutting element may include the superabrasive compact 300 having holes 330 (e.g., concentric holes) in the superabrasive body 302, the metallic member 320, and the substrate 310. The holes 330 may be concentric (e.g., in axial alignment) with the retention hole 577. One or more of the hole 330 or the retention hole 577 may be threaded. The bit fastener 540 may include a complementary thread pattern therein such that tightening of the bit fastener 540 in the retention hole 577 places a force on the superabrasive compact 300 against the bit body 562 (e.g., against the back wall 566).

Figure 5D:
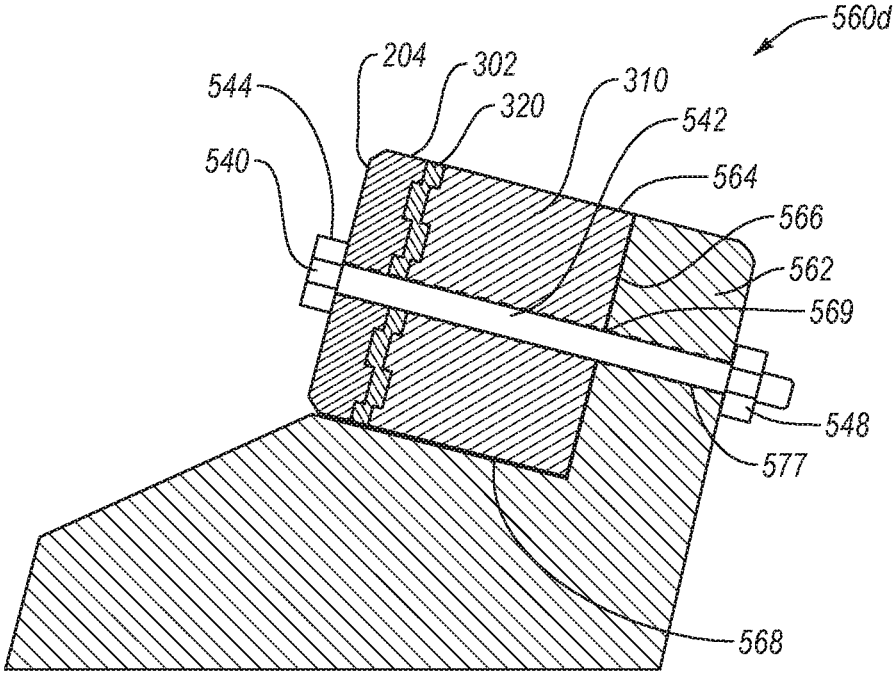
FIG. 5D is a cross-sectional view of a portion of a bit body, according to an embodiment.

In an embodiment, only a bit fastener 540 may be used to hold a cutting element in a bit assembly. FIG. 5D is a cross-sectional view of a portion of cutter bit assembly 560*d* of a bit body according to an embodiment. The cutter bit assembly 560*d* may be similar or identical to the cutter bit assembly 560*c* in one or more aspects as previously described above. For example, the cutter bit assembly 560*d* may include a portion of the bit body 562 having a cutter pocket 564 therein and at least one retaining member, such as bit fastener 540. In an embodiment, the cutter bit assembly 560*d* may include only one retaining member, such as the bit fastener 540. The cutter pocket 564 may be sized and configured to hold a cutting element therein. In an embodiment, the cutting element may be similar or identical to the superabrasive compact 300 as previously described above. For example, the cutting element may include the superabrasive compact 300 having holes 330 in the superabrasive body 302 and the metallic member 320, and hole 569 in the substrate 310. The bit fastener 540 may be configured to be disposed in the retention hole 577 and apply a clamping force on cutting element against the back wall 566, such as by force applied by the head 544 of the bit fastener 540 on the upper surface of the cutting element. In an embodiment, the retention hole 577 may be a through hole (e.g., a hole extending through and exiting the bit body). For example, the cutter bit assembly 560*d* may include the retention hole 577 substantially through back wall 566. The retention hole 577 may be concentric with one or more holes 330 in the cutting element. One or more of the holes 330 or the retention hole 577 may be threaded. The bit fastener 540 may include a shaft 542 long enough to protrude through the back wall 566 and out of the bit body 562, such that a nut or other locking mechanism 548 (e.g., cotter pin, lock wire, swaged end, etc.) may be connected to the shaft 542 at the end protruding out of the bit body 562, substantially opposite the head 544. The bit fastener 540 may include a thread pattern complementary to the thread pattern in the retention hole 577 and/or holes 330 such that tightening of the bit fastener 540 in the retention hole 577 creates a force on the superabrasive compact 300 toward and against the bit body 562 (e.g., against the back wall 566).

Figure 6A:
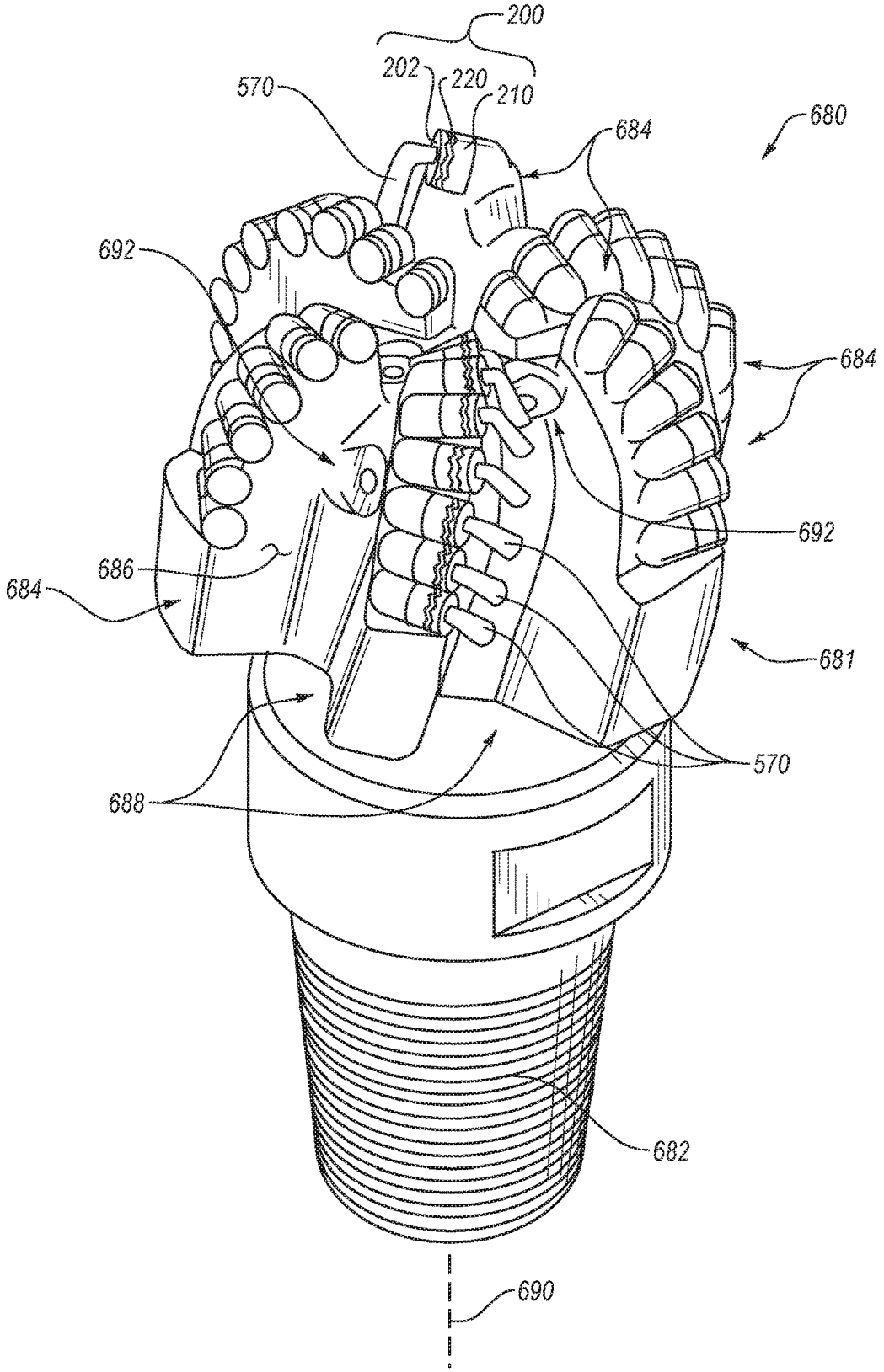
FIG. 6A is an isometric view of an embodiment of a rotary drill bit assembly that may employ one or more of the disclosed superabrasive compact embodiments.
Figure 6B:
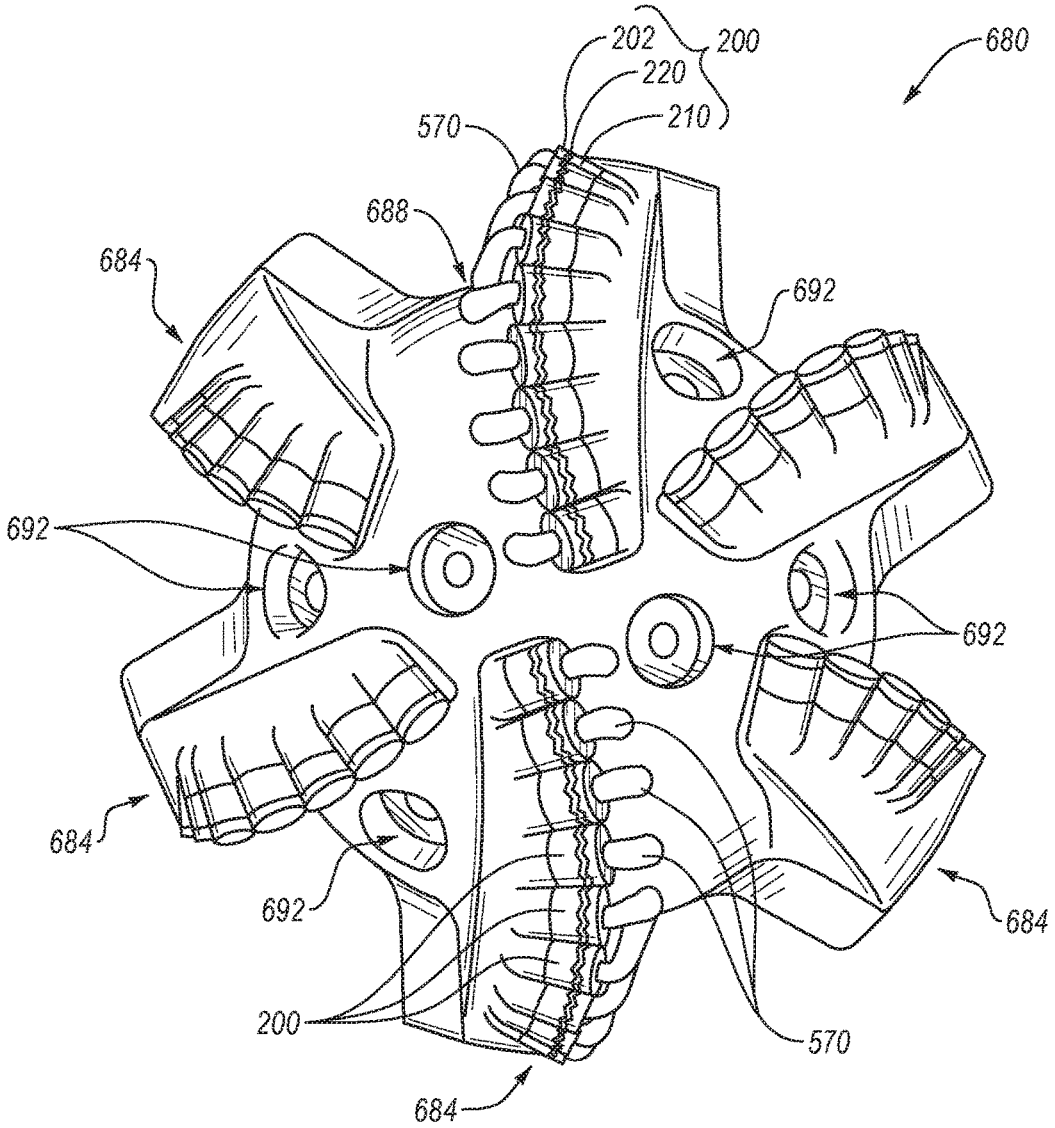
FIG. 6B is a top elevation view of the rotary drill bit assembly shown in FIG. 6A.

FIG. 6A is an isometric view and FIG. 6B is a top elevation view of an embodiment of a rotary drill bit 680. The drill bit 680 includes at least one superabrasive compact configured according to any of the previously described superabrasive compact embodiments. The rotary drill bit 680 includes a bit body 681 that includes radially- and longitudinally-extending blades 684 with leading faces 686, and a threaded pin connection 682 for connecting the bit body 681 to a drilling string. The bit body 681 defines a leading end structure for drilling into a subterranean formation by rotation about a longitudinal axis 690 and application of weight-on-bit. Referring to FIG. 6B, one or more superabrasive compacts may be configured according to any of the previously described superabrasive compact embodiments and disposed within a corresponding cutter pocket formed in the bit body 681. For example, the cutter pockets may be configured according to the cutter pockets described above with respect to FIGS. 5A-5D, which may be blind holes, pockets, or another suitable receptacle formed in the bit body 681. In the illustrated embodiment, each of a plurality of the superabrasive compacts is disposed within a corresponding one of the pockets of the blades 684. The superabrasive compacts may be configured according to any of the previously described superabrasive compact embodiment, such as superabrasive compact 200 having the superabrasive body 202, the substrate 210, and the metallic member 220 disposed therebetween. In an embodiment, the superabrasive body 202 may include polycrystalline diamond, the substrate 210 may include cobalt cemented tungsten carbide, and the metallic member 220 may include copper. However, in other embodiments, at least one superabrasive compact disclosed herein may be included in the bit body 681. In addition, if desired, in some embodiments, one or more of the superabrasive compacts may be conventional in construction. The bit body 681 may include one or more retention members associated therewith. The one or more retention members may include one or more of clamp 570 or a bit fastener (not shown). The clamp 570 may be similar or identical to the clamp 570 disclosed above with respect to FIGS. 5A-5D. The retention members may bias the superabrasive compacts 200 against the bit body 681, such that the superabrasive compacts, specifically the superabrasive bodies 202, remain secured to the bit body 681 despite not being sintered or otherwise bound to the substrate 210. Also, circumferentially adjacent blades 684 define so-called junk slots 688 therebetween, as known in the art. Additionally, the rotary drill bit 680 may include a plurality of nozzle cavities 692 for communicating drilling fluid from the interior of the rotary drill bit 680 to the superabrasive compacts 200 (e.g., PDCs).

FIGS. 6A and 6B merely depict one embodiment of a rotary drill bit that employs at least one cutting element that comprises a superabrasive compact fabricated and structured in accordance with the disclosed embodiments, without limitation. The rotary drill bit assembly 680 is used to represent any number of earth-boring tools or drilling tools, including, for example, core bits, roller-cone bits, fixed-cutter bits, eccentric bits, bicenter bits, reamers, reamer wings, any other downhole tool including PDCs, or road stripe removal systems, without limitation.

The superabrasive compacts disclosed herein may also be utilized in applications other than cutting technology. For example, the disclosed superabrasive compact embodiments may be used in wire dies, bearings, artificial joints, inserts, cutting elements, and heat sinks. Thus, any of the superabrasive compacts disclosed herein may be employed in an article of manufacture including at least one superabrasive element or compact.

Thus, the embodiments of superabrasive compacts disclosed herein may be used in any apparatus or structure in which at least one conventional PDC is typically used. In one embodiment, a rotor and a stator, assembled to form a thrust-bearing apparatus, may each include one or more superabrasive compacts configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of superabrasive compacts disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of making a superabrasive compact, the method comprising:

providing an assembly including:

a superabrasive body including a plurality of bonded superabrasive grains, an upper surface, a bonding surface having a surface feature, and a lateral surface extending between the upper surface and the bonding surface;

a substrate including a base surface, an interfacial surface having a substrate surface feature, and a substrate lateral surface extending therebetween; and a metallic member disposed between the bonding surface and the interfacial surface; and forcing the superabrasive body and substrate toward one another at a temperature below a melting point of the metallic member effective to cause the metallic member to deform into the surface feature of the bonding surface and the substrate surface feature of the interfacial surface.

2. The method of claim 1, wherein forcing the superabrasive body and substrate toward one another at a temperature below a melting point of the metallic member effective to cause the metallic member to deform into the surface feature of the bonding surface and the substrate surface feature of the interfacial surface includes subjecting the assembly to a temperature of about 800° C. or less.

3. The method of claim 1, wherein forcing the superabrasive body and substrate toward one another at a temperature below a melting point of the metallic member effective to cause the metallic member to deform into the surface feature of the bonding surface and the substrate surface feature of the interfacial surface includes bonding the superabrasive body to the substrate via the metallic member without wetting the superabrasive body or the substrate with the metallic member.

4. The method of claim 1, wherein the superabrasive body includes at least partially leached polycrystalline diamond.

5. The method of claim 1, wherein the metallic member includes at least one of a ductile metal or a braze material.

6. The method of claim 1, wherein the metallic member includes at least one of copper, nickel, silver, gold, iron, platinum, aluminum, lead, tin, or zinc.

7. The method of claim 1, wherein at least one of the surface feature or the substrate surface feature includes a recessed pattern.

8. The method of claim 1, wherein at least one of the surface feature or the substrate surface feature includes recesses having an average recess depth of at least about 125 μm.

9. The method of claim 1, wherein providing the assembly includes:

positioning the metallic member adjacent to the interfacial surface; and positioning the bonding surface adjacent to the metallic member.

10. The method of claim 1, wherein providing the assembly includes forming one or more of the surface feature in the superabrasive body or the substrate surface feature in the substrate by one or more of molding, lasing, milling, grinding, lapping, or electro-discharge machining.

11. A method of making a superabrasive compact, the method comprising:

providing an assembly including:

a polycrystalline diamond body including a plurality of bonded diamond grains, an upper surface, a bonding surface having a surface feature, and a lateral surface extending between the upper surface and the bonding surface;

a substrate including a base surface, an interfacial surface having a substrate surface feature, and a substrate lateral surface extending therebetween; and a metallic member disposed between the bonding surface and the interfacial surface; and forcing the polycrystalline diamond body and substrate toward one another at a temperature of about 800° C. or less effective to cause the metallic member to deform into the surface feature of the bonding surface and the substrate surface feature of the interfacial surface.

12. The method of claim 11, wherein forcing the polycrystalline diamond body and substrate toward one another at a temperature of about 800° C. or less effective to cause the metallic member to deform into the surface feature of the bonding surface and the substrate surface feature of the interfacial surface includes bonding the polycrystalline diamond body to the substrate via the metallic member without wetting the polycrystalline diamond body or the substrate with the metallic member.

13. The method of claim 11, wherein the polycrystalline diamond body is at least partially leached.

14. The method of claim 11, wherein the metallic member includes at least one of a ductile metal or a braze material.

15. The method of claim 11, wherein the metallic member includes at least one of copper, nickel, silver, gold, iron, platinum, aluminum, lead, tin, or zinc.

16. The method of claim 11, wherein at least one of the surface feature or the substrate surface feature includes a recessed square wave pattern.

17. The method of claim 11, wherein at least one of the surface feature or the substrate surface feature includes recesses having an average recess depth of at least about 125 μm.

18. The method of claim 11, wherein providing the assembly includes forming one or more of the surface feature in the superabrasive body or the substrate surface feature in the substrate by one or more of molding, lasing, milling, grinding, lapping, or electro-discharge machining.

19. A method of making a superabrasive compact, the method comprising:

providing an assembly including:

a polycrystalline diamond body including a plurality of bonded diamond grains, an upper surface, a bonding surface having a surface feature, and a lateral surface extending between the upper surface and the bonding surface, wherein the surface feature includes a square wave recessed pattern, and the polycrystalline diamond body is at least partially leached;

a substrate including a base surface, an interfacial surface having a substrate surface feature, and a substrate lateral surface extending therebetween, wherein the substrate surface feature includes a square wave recessed pattern; and a metallic member disposed between the bonding surface and the interfacial surface, wherein the metallic member includes at least one of copper, nickel, silver, gold, iron, platinum, aluminum, lead, tin, or zinc; and bonding the polycrystalline diamond body to the substrate via the metallic member without wetting the polycrystalline diamond body or the substrate with the metallic member.

20. The method of claim 19, wherein bonding the polycrystalline diamond body to the substrate via the metallic member without wetting the polycrystalline diamond body or the substrate with the metallic member includes subjecting the assembly to an elevated temperature of about 800° C. or less.

* * * * *